US010806677B2

(12) United States Patent
Foubet et al.

(10) Patent No.: US 10,806,677 B2
(45) Date of Patent: Oct. 20, 2020

(54) DEVICE AND METHOD FOR PACKAGING SOLID MEDICAMENTS, DEVICE FOR STORING AND DISPENSING SUCH MEDICAMENTS, AND DISPENSING METHOD

(71) Applicant: DISTRAIMED, Montastruc-la-Conseillere (FR)

(72) Inventors: Gregory Foubet, Toulouse (FR); Michel Foubet, Saint-Jean (FR); Olivier Foubet, Bressols (FR)

(73) Assignee: DISTRAIMED, Montastruc-la-Conseillere (FR)

( * ) Notice: Subject to any disclaimer, the term of this patent is extended or adjusted under 35 U.S.C. 154(b) by 110 days.

(21) Appl. No.: 16/097,020

(22) PCT Filed: May 2, 2017

(86) PCT No.: PCT/FR2017/051044
§ 371 (c)(1),
(2) Date: Oct. 26, 2018

(87) PCT Pub. No.: WO2017/191405
PCT Pub. Date: Nov. 9, 2017

(65) Prior Publication Data

US 2019/0125629 A1 May 2, 2019

(30) Foreign Application Priority Data

May 4, 2016 (FR) ..... 16 54048
Apr. 28, 2017 (FR) ..... 17 53755

(51) Int. Cl.
*A61J 7/00* (2006.01)
*A61J 1/03* (2006.01)
*B65D 25/08* (2006.01)

(52) U.S. Cl.
CPC ..... *A61J 7/0069* (2013.01); *A61J 1/03* (2013.01); *B65D 25/08* (2013.01); *A61J 7/0007* (2013.01); *A61J 7/0076* (2013.01)

(58) Field of Classification Search
CPC ..... A61J 7/0069; A61J 7/0076; A61J 7/0007; A61J 1/03; B65D 25/08
(Continued)

(56) References Cited

U.S. PATENT DOCUMENTS

2005/0006273 A1* 1/2005 Chawla ..... A61M 15/0028 206/533
2005/0173450 A1* 8/2005 Maskell ..... B65D 83/0445 221/186

(Continued)

FOREIGN PATENT DOCUMENTS

DE 202009014305 2/2011
FR 2913333 9/2008

OTHER PUBLICATIONS

International Search Report dated Jul. 19, 2017.
International Report dated Jul. 26, 2018.

*Primary Examiner* — King M Chu
(74) *Attorney, Agent, or Firm* — Ipsilon USA, LLP

(57) ABSTRACT

The invention relates to a device (1) for packaging at least one unit dose of medicaments in a divided solid pharmaceutical dosage form forming at least one cell for storing and dispensing such a unit dose, each cell comprising:

a dish (11) delimiting a volume (15) for storing such a unit dose;

a cover (12) adapted to close the storage volume;

a partition (13) adapted to be able to extend into the storage volume of the dish and to delimit a plurality of compartments (20) therein for keeping the medicaments of the unit dose separate from one another, (Continued)

characterised in that the partition (13) extending into the dish (11) is able to be removed from the dish (11). The invention also relates to a packaging method, to a device for storing and dispensing such medicaments and to a method for dispensing such medicaments to a patient.

19 Claims, 6 Drawing Sheets

(58) Field of Classification Search
USPC ..... 206/538, 534
See application file for complete search history.

(56) References Cited

U.S. PATENT DOCUMENTS

| | | | |
|---|---|---|---|
| 2015/0014203 | A1 | 1/2015 | Upchurch et al. |
| 2016/0074283 | A1 | 3/2016 | Aggarwal et al. |
| 2016/0089304 | A1 | 3/2016 | Niven |

* cited by examiner

DEVICE AND METHOD FOR PACKAGING SOLID MEDICAMENTS, DEVICE FOR STORING AND DISPENSING SUCH MEDICAMENTS, AND DISPENSING METHOD

RELATED APPLICATION

This application is a National Phase of PCT/FR2017/051044, filed on May 2, 2017, which claims the benefit of priority from French Patent Application Nos. 16 54048, filed on May 4, 2016 and 17 53755, filed on Apr. 28, 2017, the entirety of which are incorporated by reference.

BACKGROUND

Field of the Invention

The invention relates to a device and a method for packaging at least one unit dose of medicaments in a divided solid pharmaceutical dosage form, in particular not entirely in powdered form, preferably not in powdered form, such as, for example, tablets, cachets, gel capsules, capsules, pills, pastilles, sugar-coated tablets, etc. for a patient. The invention also relates to a device for storing and dispensing at least one unit dose of such medicaments and to a method for dispensing at least one unit dose of such medicaments with a view to it being administered to a patient.

DESCRIPTION OF RELATED ART

A weekly pill container is known from document FR 2913333 that allows solid medicaments to be stored and issued to a patient, with the pill container having 28 cells for storing medicaments in a thermoformed PVC holder, each cell of the pill container being compartmentalised, being sized to receive a unit dose of medicament(s) and being detachable from the weekly pill container. Each cell of the weekly pill container is sealed by a sealing label that is applied and adhered to the PVC holder. Each sealing label is adapted to be able to be torn and to allow the medicaments contained in a cell to be taken. The cells of such a weekly pill container are distributed in four columns of seven cells, each column of cells corresponding to one of the four daily unit doses, each row corresponding to the four unit doses of the same day of the week.

Each cell of such a weekly pill container has a plurality of compartments formed by the PVC holder, with each compartment being separated from adjacent compartments by a wall formed by the PVC holder forming the pill container. Such a weekly pill container allows a plurality of medicaments to be stored separate from one another and prevents distinct medicaments, comprising distinct active ingredients, from being in contact with one another in a cell of the weekly pill container when they are stored.

Such a pill container nevertheless has disadvantages. On the one hand, it allows the patient, with the various medicaments being separated from one another, to be selective with the various individualised medicaments when the cell is open, which involves keeping some medicaments and rejecting other medicaments from among the unit dose of medicaments. Such selection can enable the patient to avoid taking a particular medicament. Such rejection is likely to lead to harmful consequences for the patient: at best, the treatment loses its therapeutic effect; at worst, not taking this medicament results in the development of secondary effects detrimental to the patient.

On the other hand, such a weekly pill container requires transferring the medicaments contained in a cell to an additional container separate from the pill container in order to take the medicaments. Indeed, such a pill container does not allow the medicaments to be manually taken one at a time from each compartment of the cell due to the hindrance caused by the wall separating two adjacent compartments.

A device for furnishing medicaments is also known from document US 2015/0014203, in which a blister pack, formed by a semi-rigid plastic film forming a plurality of dishes closed by an adhesive aluminium sheet on the semi-rigid plastic film, is mounted on a holder having openings for receiving dishes of the blister pack, with the holder and the blister pack being placed as a whole in a box for furnishing medicaments. Each dish contains a single medicament. Such a device also has the aforementioned disadvantages.

OBJECTS AND SUMMARY

Therefore, the invention aims to overcome these disadvantages.

Furthermore, within the context of the treatment of certain diseases, for example within the context of neurodegenerative diseases, it is advantageous for the patient to be able to be provided with a unit dose of solid medicaments in the divided state and with a low particle size for mixing with a soft consistency food product composition, in particular a compote or a jam, so that the patient can easily ingest the mixture.

The weekly pill container of document FR 2913333 does not allow the patient to be provided with such a mixture without involving the medicaments of the unit dose being transferred to an additional container separate from the pill container to facilitate the ingestion of the unit dose of medicaments.

Therefore, some aspects of the invention also aim to overcome these disadvantages.

Therefore, the aim of the invention is a packaging device and method, a storage and dispensing device and a method for dispensing at least one unit dose of medicaments in a divided solid pharmaceutical dosage form, in particular not entirely in powdered form, preferably not in powdered form, such as, for example, tablets, cachets, gel capsules, capsules, pills, pastilles, sugar-coated tablets, etc limiting the risk of the patient being selective with medicaments, in particular completely removing the risk, when the medicaments are taken.

Therefore, the aim of the invention is such a storage and dispensing device and a method for dispensing at least one unit dose of such medicaments that are safeguarded.

Thus, the aim of the invention is a packaging device and method, a storage and dispensing device and a method for dispensing at least one unit dose of such medicaments that at the same time allows the medicaments to be stored separate from one another, limiting the risks of interactions between various medicaments when they are stored, but also allows safeguarded dispensing of the medicaments, i.e. limiting the risks of the patient being selective with medicaments.

In particular, the aim of the invention is such a device for storing and dispensing at least one unit dose of such medicaments, the use of which by a patient is facilitated. In particular, the aim of the invention is such a device for storing and dispensing at least one unit dose of such medicaments that does not require the use of an additional container, such as a cup separate from the pill container for dispensing the unit dose of medicaments to the patient.

Some aspects of the invention also aim, in combination, to propose a packaging device and method, a storage and dispensing device and a method for dispensing at least one unit dose of such medicaments allowing the patient to be provided with a unit dose of solid medicaments in the divided state with a view to it being mixed with a soft consistency food product composition, in particular a compote or a jam, so that the patient can easily ingest the mixture.

To this end, the invention relates to a device for packaging at least one unit dose of medicaments in a divided solid pharmaceutical dosage form, in particular not entirely in powdered form, preferably not in powdered form, forming at least one cell for storing and dispensing such a unit dose, i.e. intended to be administered to a patient at a predetermined time, each cell comprising:

a dish delimiting a volume for storing such a unit dose;

a cover adapted to close the storage volume;

a partition adapted to be able to extend into the storage volume of the dish and to delimit a plurality of compartments therein for keeping the medicaments of the unit dose separate from one another, characterised in that the partition extending into the dish is able to be removed from the dish.

The invention therefore relates to a device for packaging at least one unit dose of medicaments in a divided solid pharmaceutical dosage form adapted to be able to form at least one cell for storing and dispensing such a unit dose, the packaging device comprising:

at least one dish, each dish delimiting a volume for storing such a unit dose;

at least one cover, each cover being adapted to close the storage volume of a dish;

at least one partition, each partition being adapted to be able to extend into the storage volume of a dish and to delimit a plurality of compartments therein for keeping the medicaments of the unit dose separate from one another, characterised in that each partition is able to be removed from the dish.

Throughout the document, the term "unit dose of medicaments" normally denotes a set of medicaments intended to be substantially administered as a single dose to a patient at a given time, with said set of medicaments complying with the dosing schedule of a medical prescription intended to treat at least one disease affecting this patient. It can involve a set of distinct medicaments formed by medicaments in distinct pharmaceutical dosage forms and/or comprising distinct active substances and/or dosages of distinct active substances. A unit dose of medicaments also can comprise a plurality of identical medicaments, i.e. can comprise a plurality of medicaments comprising the same active substance(s), with the same dosage of the active substance(s) and in the same pharmaceutical dosage form(s).

Any divided solid pharmaceutical dosage form that is to some extent in powdered form or is not in powdered form can be stored in a device according to the invention and dispensed from this device. In particular, the solid pharmaceutical dosage form that is not in powdered form can be selected from the group formed by tablets, cachets, gel capsules, capsules, pills, pastilles, sugar-coated tablets, etc.

The inventors have noted that a device for storing and dispensing at least one unit dose of medicaments according to the invention, in which at least one partition is removable upon opening at least one cell for storing and dispensing such medicaments, actually allows safeguarded storage of at least one unit dose of medicaments before opening at least one cell containing this unit dose of medicaments, with the various medicaments of the unit dose of medicaments being separated when the corresponding storage and dispensing cell is closed. It therefore allows storage of the various medicaments of a unit dose of medicaments in a state in which they are separated from one another by avoiding any contact between the various medicaments and by avoiding any interference between these medicaments when they are stored. It also allows facilitated consolidation and dispensing of the medicaments of the unit dose of medicaments mixed in the dish when the storage cell is open and the removable partition is removed from the dish. They have also noted that a packaging device and method according to the invention allows a device to be formed for storing and dispensing at least one unit dose of medicaments.

According to a first variant of the invention, the packaging device is devoid of medicaments and comprises at least one dish, at least one cover and at least one removable partition in the disconnected state (in "kit" form), with the dish(es), the cover(s) and the removable partition(s) being separated from one another and being adapted to be able to form, following assembly with the unit dose of medicaments, at least one cell for storing and dispensing at least one unit dose of medicaments, with at least one such cell containing a unit dose of medicaments.

According to a second variant of the invention, the packaging device is in the partially assembled state, i.e. in a state in which the removable partition(s) is/are disposed in the storage volume(s) by forming storage compartments with the dish(es), with the cover(s) not sealing the opening of the dish(es).

A packaging device according to the second variant of the invention is used during a method for preparing a device for storing and dispensing at least one unit dose of medicaments. It is used during a step of dividing at least one unit dose of medicaments into compartments of a packaging device according to the invention before installing the cover. In this configuration of a packaging device in the partially assembled state, the dish(es) and the removable partition(s) is/are disposed to receive medicaments before installing the cover(s), sealing the dish(es) and forming the cell(s).

Advantageously, and according to either of the first and second variants of the invention, the dish has a peripheral shoulder delimiting an opening of the dish, with the cover being formed by a sealing film adapted to be able to adhere to the peripheral shoulder of the dish.

Advantageously, at least one dish, in particular each dish, has a peripheral shoulder delimiting an opening of the dish, in particular each dish, at least one cover, in particular each cover, being formed by a sealing film adapted to be able to adhere to the peripheral shoulder of the dish, in particular of each dish. The peripheral shoulder of each dish forms a surface, in particular a substantially flat surface, for receiving and adhering the sealing film on the dish, the dish containing a removable partition and a unit dose of medicaments, the adhesion of the sealing film on the peripheral shoulder of the dish allowing the dish to be sealed and a cell for storing and dispensing at least one unit dose of medicaments to be formed.

Advantageously, and according to some embodiments of the invention, the sealing film has a main face, named adhesive face, having at least one adhesive zone disposed to be able to adhere to the peripheral shoulder of the dish. Advantageously, and according to some embodiments of the invention, said adhesive face of the sealing film is coated with an adhesive material. Advantageously, and according to the invention, the sealing film is formed by an adhesive material. Advantageously, the sealing film is formed by an adhesive cellulose material, in particular adhesive paper. Advantageously, the sealing film comprises a detachable film for protecting the adhesive material, the detachable protective film being detachable on at least part of the surface of the sealing film. Any type of adhesive material can be used, as long as the detachable film is compatible with contact with the medicaments. Advantageously, the sealing film has a perforation for subsequent opening of the cell by tearing the sealing film Such a perforation allows, on the one hand, subsequent opening of the cell containing the unit dose of medicaments and, on the other hand, the extraction of the removable partition.

Advantageously, according to some embodiments of the invention, the sealing film is formed by a basically cellulose material, in particular paper, for which said adhesive face is self-adhesive and is coated with a detachable protective film.

Advantageously, according to some embodiments of the invention, said adhesive face has an adhesive peripheral zone coated with a detachable silicon protective film and is adapted to be able to be adhered to the peripheral shoulder of the dish when the silicon film is removed, and has a central zone, preferably non-adhesive, intended to extend facing the storage space/volume, with the storage space/volume containing the removable partition and the unit dose of medicaments.

However, there is nothing preventing said adhesive face from having a second adhesive zone, extending towards the inside of the peripheral zone, it is also covered with a piece of detachable film and is adapted to be able to be adhered at least to a peripheral edge of the removable partition when said piece of detachable film is removed. In this configuration, tearing the sealing film concomitantly allows the cell to be opened and the removable partition to be extracted.

Advantageously, and according to the invention, the sealing film has a second main face, named printed face, opposite said adhesive face and having at least one inscription.

Advantageously, said printed face has at least one inscription intended to identify the patient, to identify the medicament(s), to identify the date for taking the medicament(s) and/or to identify the time for taking the medicament(s). The inscription can assume any form that can be identified by the patient, by the prescriber, by a caregiver or by means of an identifier reader. It can involve, for example, written characters, a colour code, a bar code or a QR code. It can involve, for partially sighted patients, inscriptions written in Braille. Said printed face has inscriptions relating to the patient and/or to the medical prescription.

Advantageously, according to some embodiments of the invention, the dish is of elongated shape in a main elongation direction and has:

a larger dimension parallel to the main elongation direction of the dish, in particular with a value between 60 mm and 150 mm; and a width in a direction perpendicular to the main elongation direction with a value between 20 mm and 50 mm.

Advantageously, according to this embodiment of the invention, each dish is of elongated shape in a main elongation direction and has:

a larger dimension parallel to the main elongation direction of the dish, in particular with a value between 60 mm and 150 mm; and a width in a direction perpendicular to the main elongation direction with a value between 20 mm and 50 mm.

Advantageously, and according to the invention, the dish has a depth extending perpendicular to the main elongation direction, perpendicular to the width and with a value that is lower than the width, in particular between 10 mm and 20 mm.

Advantageously, and according to some embodiments of the invention, each dish has a depth extending perpendicular to the main elongation direction, perpendicular to the width and with a value that is lower than the width, in particular between 10 mm and 20 mm. However, there is nothing preventing, according to some other embodiments of the invention, the depth from having a value that is greater than the width.

The dimensions of each dish of the packaging device can be identical. However, there is nothing preventing provision to be made for at least two dishes of the packaging device to have different dimensions and to adapt the dimensions of each sealing film and the dimensions of each removable partition to the dimensions of each dish.

Advantageously, and according to the invention, each dish is formed from a material selected from the group formed by thermoplastic materials and thermosetting materials. The thermoplastic material can be selected from the group formed by polystyrene (PS), polyethylene (PE), polyethylene terephthalate (PET), low density polyethylene (LDPE), polypropylene (PP), polycarbonate (PC), acrylonitrile butadiene styrene (ABS), polyvinyl chloride (PVC), polymethyl methacrylate (PMMA), impact polystyrene (IPS) and mixtures thereof. Advantageously, each dish is formed by a transparent material.

Advantageously, each removable partition is formed by a material selected from the group formed by thermoplastic materials and thermosetting materials. The material forming the dish can be identical to or different from the material forming the partition.

Advantageously, according to some embodiments of the invention, the packaging device is adapted to be able to receive medicaments and to form a plurality of cells for storing and dispensing a plurality of unit doses of such medicaments, with the cells of the plurality of storage and dispensing cells being connected to one another in the form of a tray of cells for storing and dispensing medicaments. In particular, each cell of the plurality of cells for storing and dispensing medicaments is connected to the adjacent cells by breakable links having perforations for easily separating each cell and the adjacent cells. Each cell of the device for storing and dispensing medicaments formed from the packaging device therefore can be detached from the device for storing and dispensing medicaments and from the adjacent cells.

In particular, according to a preferred embodiment of the invention, the packaging device is adapted to be able to form a weekly pill container, the number of cells forming the storage tray being selected to allow one, two, three or four unit dose(s) of medicaments per day for seven days of weekly treatment. Such a packaging device according to the invention advantageously comprises 28 cells for storing and dispensing 28 unit doses of medicaments.

Advantageously, according to this preferred embodiment of the invention, the packaging device is a device for packaging a plurality of unit doses of such medicaments, comprising:

a plurality of dishes connected to one another in the form of a tray for receiving medicaments;

a sheet for sealing the plurality of dishes formed by a plurality of sealing films, each sealing film being adapted to be able to seal a dish; and a plurality of removable partitions, in particular connected to one another in the form of a tray of removable partitions, each partition of the plurality of removable partitions being adapted to:

be able to extend into the storage volume of a dish by delimiting a plurality of compartments therein;

be able to form, after receiving a unit dose of such medicaments and a cover, a cell for storing and dispensing a unit dose of medicaments, in which at least two medicaments of the unit dose of medicaments are separated from one another; and be able to be extracted from the dish, so that the medicaments are not separated from one another in the dish following the extraction of the partition.

Advantageously, and according to the invention, the packaging device is devoid of medicaments. The packaging device is in the at least partially disconnected state (in "kit" form), the plurality of dishes, the plurality of covers and the plurality of removable partitions not forming a plurality of cells for storing a plurality of unit dose of medicaments.

Advantageously, and according to the invention, the sealing sheet comprises a plurality of sealing films, the sealing sheet and the sealing films being sized so that each film of the plurality of films forming the sheet can seal the opening of a dish of the packaging device. The sealing sheet has perforations arranged to allow the separation of a sealing film. The perforations of the sealing film extend in line with the perforations of the plurality of storage dishes of the reception tray and allow a cell to be separated from the plurality of cells with a view to dispensing a unit dose of medicaments to a patient.

Advantageously, according to some embodiments of the invention, the packaging device comprises a plurality of removable partitions connected to one another in the form of a tray of partitions and so that each partition of the plurality of removable partitions can cooperate with a dish of the plurality of dishes of the tray for receiving and storing medicaments and form a plurality of compartments in each dish. Preferably, each partition of the plurality of removable partitions is connected to the adjacent removable partitions by means of a link having a perforation. However, there is nothing preventing at least one partition, in particular each partition, from being in the form of a removable partition separated from the other partitions of the packaging device according to the invention.

Advantageously, and according to the invention, each dish of the plurality of dishes of the tray for receiving medicaments has a peripheral shoulder for adhering a sealing film bordering the opening of the dish. Advantageously, and according to the invention, with each dish having a peripheral shoulder for adhering a sealing film bordering the opening of the dish, the peripheral shoulders for adhering the plurality of dishes are substantially coplanar. The plurality of coplanar peripheral shoulders allows application of the sealing sheet of the plurality of dishes so as to close the storage space/volume of each dish of the plurality of dishes and to form a device for storing and dispensing at least one unit dose of such medicaments.

Advantageously, the plurality of dishes of the tray for storing the unit dose of such medicaments is a receptacle for medicaments, in which each dish of the receptacle is connected to the adjacent dishes by means of links having perforations for easily separating the cell and the adjacent cells. Advantageously, the sealing sheet of the plurality of dishes also has perforations for separating each sealing film and each cell of the tray for receiving medicaments, with the perforations of the sealing sheet being complementary to the perforations of the reception tray. Advantageously, each sealing film of the sealing sheet also has perforations for opening each corresponding cell by tearing the sealing film.

Advantageously, the tray for receiving medicaments is formed by a material selected from the group formed by thermoplastic materials and thermosetting materials. The tray for storing medicaments can be obtained by thermoforming a thermoplastic material, by forming the plurality of dishes and the perforations in a single step.

Advantageously, and according to the invention, the packaging device comprises:

a perforated tray for receiving medicaments, forming a plurality of juxtaposed dishes;

a perforated sheet of sealing films; and a perforated set of removable partitions.

The tray is perforated so as to allow the dishes to be manually separated from one another (by tearing the perforations). The sheet is perforated so as to allow the sealing films to be manually separated from one another (by tearing the perforations). The set of removable partitions is perforated so as to allow the removable partitions to be manually separated from one another (by tearing the perforations). Furthermore, preferably, the various perforations are adapted to allow the dish, the sealing film and the removable partition to be simultaneously manually separated from the same cell (by simultaneously tearing the various perforations) in a single manoeuvre. It is thus possible to separate a cell of a storage and dispensing device according to the invention that is obtained with such a packaging device, with this cell containing a unit dose of such medicaments, so that it can be dispensed to the patient.

Advantageously, and according to the invention, each removable partition has a plurality of partitions for separating medicaments and forms, together with the bottom of the dish, a plurality of compartments for storing medicaments in the dish in which it is located.

Advantageously, and according to the invention, at least one, in particular each, removable partition is a bottomless partition. Such a removable partition is configured to allow lateral separation of medicaments of a unit dose of medicaments in the dish when the removable partition extends into the storage volume of the dish and delimits therein, together with the dish, a plurality of compartments for keeping medicaments of the unit dose separated from one another. Such a removable partition is also configured to allow the medicaments to be released in a form in which they are not separated from one another in the dish, by simply extracting the removable partition from the dish.

Such a removable partition has, between two adjacent partitions, an opening for keeping medicaments of the unit dose of medicaments in contact with the bottom of the dish. Such a removable partition is adapted so that the medicaments of the unit dose of medicaments remain in a form in which they are not separated from one another in the dish following the extraction of the removable partition.

Advantageously, the removable partition has between 2 and 10 partitions and forms between 3 and 11 compartments in the dish. Advantageously, the removable partition has 6 partitions and forms 7 medicament storage compartments in the dish. Of course, without departing from the scope of protection of the invention, the removable partition can form more than 7 medicament storage compartments in the dish. The partitions of the removable partition can be in any form adapted to allow storage of a plurality of medicaments in the separated state. The partitions of the removable partition are sized to be able to form, together with the bottom of the dish, a plurality of compartments for storing medicaments in a form in which they are separated from one another when the removable partition is located in the dish. The partitions of the removable partition are sized to be able to substantially extend in contact with the bottom of the dish, but not integral with the bottom of the dish, and so as to provide the opening for keeping medicaments in contact with the bottom of the dish, in particular when storing medicaments separate from one another and when extracting the removable partition.

The removable partition in itself comprises neither a compartment for storing medicaments nor a dish for storing medicaments. In particular, the removable partition is a bottomless partition comprising transverse partitions (i.e. adapted to extend transversely in the dish) providing an opening between two adjacent partitions, with this opening allowing the passage of medicaments. Thus, the extraction of the removable partition from the dish containing the medicaments does not lead to the extraction of the medicaments from the dish, with the medicaments remaining housed in the dish.

Advantageously, and according to the invention, the partitions of the removable partition can be equidistant and can form compartments of the same size in the dish. However, it is also possible for the partitions of the removable partition to form compartments of different sizes in the dish. Such a device allows at least one unit dose of medicaments with different sizes of medicaments to be stored and dispensed. Advantageously, at least two compartments have distinct sizes.

Furthermore, there is nothing preventing the number of partitions from differing from one removable partition to another. The partitions can be in any form as long as they allow compartments to be formed in the dish, with the bottom of each compartment being formed by the bottom of the dish. Each partition can have two substantially parallel opposite main faces. It can also have two opposite main faces that are not parallel, so that the compartments formed in the dish are flared upwards, i.e. towards the face of the partition intended to receive the cover. Such upwardly flared compartments allow the dish to be easily filled. However, there is nothing preventing the compartments formed in the dish from being flared downwards, i.e. towards the bottom of the dish. Such downwardly flared compartments facilitate the spreading of the medicaments on the bottom of the dish.

Advantageously, and according to the invention, the dish has a bottom, named storage bottom, and a lateral wall, said storage bottom and the lateral wall delimiting the volume for storing the unit dose of medicaments. Advantageously, according to some embodiments of the invention, said storage bottom is substantially flat.

Advantageously, in combination and according to another aspect of the invention, a bottom part of the dish forms an indentation for collecting medicaments of the unit dose of medicaments that is adapted to be able to receive and contain the medicaments and to allow them to be crushed, in particular ground, in the indentation. The bottom of the dish is formed by said storage bottom and by the indentation and continuously extends between said storage bottom and the indentation.

Advantageously, and according to this other aspect of the invention, the indentation allows the medicaments of the unit dose of medicaments to be consolidated in the indentation following the extraction of the removable partition, the crushing, in particular the grinding, of the medicaments and the formation of a unit dose of medicaments in powdered form kept in the indentation.

The indentation is sized to be able to contain the medicaments of the unit dose of medicaments. It is also sized to be able to receive a device for crushing medicaments in the indentation and to allow crushing, in particular grinding, of the medicaments in the indentation. Thus, advantageously and according to this other aspect of the invention, the indentation has a lateral wall, named indentation wall, of substantially rotationally symmetrical shape, in particular rotationally cylindrical. Advantageously, said wall of the indentation can be of frustoconical shape. Advantageously, and according to this other aspect of the invention, the indentation has a bottom. The bottom of the indentation can be flat. It also can be substantially round and adapted to allow the medicaments to be crushed, in particular by means of a crushing and/or grinding component, such as a pestle. The bottom of the indentation can be smooth. It also can have asperities sized to be able to cooperate with a crushing component, in particular a pestle, and to allow crushing, in particular grinding, of the medicaments.

The material forming the indentation, its shape, the thickness of the bottom of the indentation and said wall of the indentation, and the asperities forming the bottom of the indentation are selected to allow effective crushing, in particular grinding, of the medicaments and to receive a soft consistency food product and allow it to be mixed with the crushed medicaments. The crushed medicaments are in the form of a solid in the divided state with a low particle size, in particular in the form of a powder.

Advantageously, according to some embodiments of the invention, the indentation is an indentation that can deform between a retracted form, in which the indentation does not allow the medicaments to be crushed, and a deployed form, in which the depth of the indentation is adapted to receive the medicaments and to allow them to be crushed. Such a deformable indentation can be an indentation that can be retracted/deployed along an axis perpendicular to said storage bottom of the dish. Such a deformable indentation allows the spatial requirement of the packaging device to be limited when the deformable indentation is in the retracted position. It also allows the medicaments of the unit dose of medicaments to be collected and the medicaments to be crushed, in particular ground, when the deformable indentation is in the deployed position and the dispensing device is in the crushing position. Such a deformable indentation can have a lateral wall forming successive transverse folds arranged to allow a deformation, named concertina-like deformation.

Said storage bottom and the indentation allow, after the cell is opened and the removable partition is extracted from the storage dish, the medicaments of a unit dose of medicaments to be collected in the indentation simply by sliding the medicaments between said storage bottom and the indentation in which the medicaments are kept so that they can be crushed or ground, mixed in the indentation with a soft consistency food product and more easily taken by the patient.

According to this aspect of the invention, the indentation and said storage bottom together form the bottom of the dish, so that the medicaments of the unit dose of medicaments can be brought, following the extraction of the removable partition, from said storage bottom towards the indentation by sliding on the storage bottom by simply inclining the dish, allowing the medicaments to slide between said storage bottom and the indentation.

Advantageously, and according to this aspect of the invention, the indentation forms a crushing, in particular grinding, mortar for the medicaments of the unit dose of medicaments.

Advantageously, and according to some aspects of the invention, with the indentation and said storage bottom being formed by the same material, the indentation and said storage bottom have different thicknesses, with the thickness of the material forming the indentation being greater than the thickness of the material forming said storage bottom. However, there is nothing preventing the material forming said storage bottom of the dish and the material forming the indentation from having the same thickness.

Advantageously, and according to some aspects of the invention, the bending stiffness of the indentation is greater than the bending stiffness of said storage bottom. However, according to some other aspects of the invention, the bending stiffness of the indentation is substantially equal to the bending stiffness of said storage bottom.

Advantageously, and according to this aspect of the invention, the dish is formed by thermoforming a thermoplastic material or a thermosetting material.

According to some aspects of the invention, there is nothing preventing some dishes of the plurality of dishes from having such an indentation and other dishes of the plurality of dishes from not having such an indentation.

The invention also pertains to a method for packaging at least one unit dose of medicaments in a divided solid pharmaceutical dosage form, in which a packaging device according to the invention is used to obtain a device for storing and dispensing at least one ready-to-use unit dose of medicaments according to the invention. Therefore, the invention pertains to such a method for manufacturing a device for storing and dispensing at least one unit dose of such medicaments, in which a packaging device according to the invention is used.

In particular, the invention pertains to a method for packaging at least one unit dose of medicaments in a divided solid pharmaceutical dosage form, in particular not entirely in powdered form, preferably not in powdered form, wherein:

- a packaging device according to the invention is selected;
- a removable partition is placed in a dish, in particular in each dish, of the packaging device;
- medicaments in a divided solid pharmaceutical dosage form, in particular not entirely in powdered form, preferably not in powdered form, are divided into at least two storage compartments formed by the removable partition placed in the dish, in particular in each dish (in accordance with a medical prescription intended for a patient); and
- the dish, in particular each dish, of the device comprising the medicaments is closed by applying the cover. A device for storing and dispensing at least one unit dose of medicaments in a divided solid pharmaceutical dosage form, in particular not entirely in powdered form, preferably not in powdered form, is thus formed that is ready to be dispensed or made available to a patient.

Such a distribution of the medicaments is carried out by any suitable means. It can involve manual distribution carried out by an operator. It also can involve automated dispensing carried out by an automaton according to the medical prescription. It also can involve semi-automated dispensing, in which an operator is assisted by an automaton for detecting and confirming the distribution of the medicaments.

Advantageously, and according to the invention, different inscriptions are printed on the cover, in particular at least one item of personal data relating to the patient to be treated and/or at least one item of data relating to a medical prescription. It is possible, with the cover being a sealing film, to print at least one item of personal data relating to the patient to be treated and/or at least one item of data relating to the medical prescription before applying the sealing film on the dish. For example, such printing is carried out by means of a printer. However, there is nothing preventing the printing of at least one item of personal data relating to the patient to be treated and/or at least one item of data relating to the medical prescription from being printed on the tray for storing medicaments after the sealing film is applied on the dish.

Advantageously, and according to the invention, with the cover being a sealing film having a main face, named adhesive face, having at least one adhesive zone provided to be able to adhere to the peripheral shoulder of a dish, with said adhesive face being protected by a detachable protective film, the detachable protective film is removed and the sealing film is applied on the dish(es) comprising the removable partition(s) and at least one unit dose of medicaments.

The invention also pertains to a device for storing and dispensing at least one unit dose of medicaments in a divided solid pharmaceutical dosage form, in particular not entirely in powdered form, preferably not in powdered form, obtained by a packaging method according to the invention. The invention also pertains to a device for storing and dispensing at least one unit dose of medicaments obtained from a packaging device according to the invention.

Therefore, the invention pertains to a device for storing and dispensing at least one unit dose of medicaments in a divided solid pharmaceutical dosage form, in particular not entirely in powdered form, preferably not in powdered form, with each unit dose being intended to be administered to a patient at a predetermined time and being distributed in a cell for storing and dispensing such a unit dose, each cell comprising:

- a dish delimiting a volume for storing such a unit dose and containing such a unit dose;
- a cover adapted to close the storage volume;
- a partition extending into the storage volume and delimiting a plurality of storage compartments therein for keeping the medicaments of the unit dose separate from one another, the partition extending into the dish;

characterised in that the partition extending into the dish is able to be removed from the dish. Therefore, the invention relates to such a device for storing and dispensing at least one unit dose of such medicaments, wherein at least one storage cell is closed and contains a unit dose of medicaments. The invention therefore relates to such a storage and dispensing device that is provided with at least one unit dose of such medicaments and is ready to be used by a patient or is being used by a patient.

Advantageously, and according to the invention, the removable partition is adapted to be able to be extracted from the dish, with the medicaments then no longer being separated from one another in the dish following the extraction of the removable partition.

Advantageously, and according to some particular embodiments of the invention, the removable partition is secured to the cover so as to allow, during the opening of the storage cell, simultaneous extraction of the removable partition from the dish and random distribution of the medicaments in the dish. In this embodiment of a device according to the invention, the operation of dispensing a unit dose of medicaments is simplified and allows a unit dose of medicaments to be formed in the dish in a single step, helping the patient to take the unit dose of medicaments and without having to use an additional container.

However, there is nothing preventing, in other embodiments, the removable partition from extending into the dish without any connection with the cover, so that opening the dish allows the removable partition to be extracted from the dish after opening the dish and allows subsequent mixing of the medicaments in the dish.

Advantageously, and according to other particular embodiments of the invention, the removable partition is separated from the cover so that opening the storage cell necessitates delayed extraction (i.e. following removal of the cover) of the removable partition from the dish, so as to form a random distribution of the medicaments in the dish.

In these other embodiments, the removable partition advantageously has gripping means adapted to facilitate the extraction of the removable partition after opening the cell. For example, the removable partition has a tab for gripping and extracting the removable partition.

Advantageously, in combination and according to another aspect of a device for storing and dispensing a unit dose of medicaments according to the invention, a bottom part of the dish forms an indentation for collecting medicaments of the unit dose of medicaments that is adapted to be able to receive and contain the medicaments, and to allow them to be crushed, in particular ground, in the indentation.

According to this other aspect of the invention, the medicaments of the unit dose of medicaments contained in the cell are distributed in the storage compartments formed by the partition in the storage volume. In particular, with the bottom of the dish being formed by the indentation and by a substantially flat bottom part, named storage bottom, the medicaments of the unit dose of medicaments contained in the cell are distributed in the storage compartments formed by the partition, by the storage bottom and by the cover. However, there is nothing preventing one of the medicaments of the unit dose of medicaments from being stored in the indentation. One of the storage compartments is then formed by the indentation, by the partition and by the cover.

Advantageously, and according to a preferred variation of the invention, the storage and dispensing device comprises a plurality of storage cells connected to one another in the form of a tray for storing and dispensing medicaments (or pill container). At least one, in particular each, storage cell of the storage tray is formed by a removable partition, a dish and a cover forming a storage volume containing a unit dose of medicaments separated from one another. In this variant, the cover is a sheet for sealing the plurality of cells, the sealing film being formed by a plurality of sealing films, the sheet and the sealing films being sized so that each film of the plurality of sealing films seals the opening of a dish of the plurality of dishes.

Advantageously, according to this particular aspect of a device for storing and dispensing a unit dose of medicaments according to the invention, at least one, in particular each, dish has a bottom, part of the bottom of at least one, in particular each, dish forms an indentation sized to be able to contain the medicaments and to allow them to be crushed, in particular ground, in the indentation.

Advantageously, and according to the invention, each storage cell of the device for storing and dispensing such medicaments contains a unit dose of such medicaments corresponding to a medical prescription.

Advantageously, and according to the invention, the storage cells are connected to one another by perforations adapted to allow each cell to be separated from the adjacent cells by manually tearing these perforations.

The sealing sheet has perforations that are arranged to allow films to be separated from the sealing sheet. The perforations of the sealing sheet extend in line with the perforations of the plurality of storage dishes and with the perforations of the plurality of removable partitions, so as to allow a single cell to be separated from the plurality of cells in order to dispense a single unit dose of medicaments to a patient. Preferably, the perforations are adapted to allow a cell to be separated by simultaneously manually tearing various perforations in a single manoeuvre.

Advantageously, the storage and dispensing device according to the invention in the form of a tray has a plurality of eyelets for attaching and storing the tray in a vertical position.

The invention also pertains to a method for providing a unit dose of medicaments in a divided solid pharmaceutical dosage form, in which a device according to the invention is used. The invention therefore also pertains to a method for supplying a unit dose of medicaments in a divided solid pharmaceutical dosage form, in which a device according to the invention is used.

The invention particularly pertains to a method for dispensing at least one unit dose of medicaments in a divided solid pharmaceutical dosage form, in particular not entirely in powdered form, preferably not in powdered form, to a patient, wherein:

- a device (said storage and dispensing device corresponding to a medical prescription) for storing and dispensing at least one unit dose of medicaments in a divided solid pharmaceutical dosage form, in particular not entirely in powdered form, preferably not in powdered form, is selected;
- the cover of a cell of the storage and dispensing device corresponding to the unit dose of medicaments is removed; and
- the removable partition is extracted from the cell so that the medicaments are no longer separated from one another in the dish; and
- the unit dose of medicaments is dispensed to the patient.

Advantageously, and according to the invention:

- a device for storing and dispensing at least one unit dose of medicaments in a divided solid pharmaceutical dosage form, in particular not entirely in powdered form, preferably not in powdered form, is selected; then
- a cell for storing and dispensing such a unit dose is separated from the storage device; then
- the cover of this cell of the storage and dispensing device corresponding to the unit dose of medicaments is removed; and
- the removable partition is extracted from this cell so that the medicaments are no longer separated from one another in the dish; and
- the unit dose of medicaments is dispensed to the patient.

Advantageously, and according to the invention, the cover is removed and the removable partition is extracted simultaneously, with the removable partition being secured to the cover.

Advantageously, in combination and according to another aspect of a method for dispensing a unit dose of medicaments according to the invention, a bottom part of the dish forming an indentation for collecting and for crushing, in particular for grinding, the medicaments of the unit dose of medicaments is sized to be able to receive and contain the medicaments, the medicaments are moved into the indentation following the extraction of the removable partition and the medicaments of the unit dose of medicaments are crushed, in particular ground, in the indentation.

The crushing, in particular the grinding, is carried out using any suitable means. Advantageously, the crushing and/or the grinding is carried out, for example, by means of a pestle, with the indentation acting as a crushing mortar. Such crushing is carried out by rotating the pestle along an axis substantially orthogonal to the opening plane of the dish, with the pestle compressing and crushing the medicaments in the indentation. Preferably, the indentation is of substantially rotationally symmetrical shape, in particular rotationally cylindrical, and is adapted to be able to allow the medicaments to be consolidated in the indentation and to cooperate with such a pestle and to allow the medicaments to be crushed.

There is nothing preventing the crushing, in particular the grinding, from being carried out by any other physical means for breaking down the medicaments. Such a physical means for breaking down the medicaments is selected such that it does not modify the chemical composition, in particular the chemical composition of the active ingredients, of the unit dose of medicaments.

Advantageously, the dish is surface mounted in a concave holder formed by a solid material and having a hollow shape matching the convex outer face of the dish. Such a concave holder allows, on the one hand, the shape of the indentation to be maintained and, on the other hand, the dish to be rotationally locked when crushing the medicaments.

According to this other aspect of a dispensing method according to the invention, a soft consistency food product is added to the unit dose of crushed medicaments and the mixture of the soft consistency food product and the unit dose of medicaments is dispensed to the patient.

The invention also relates to a device for packaging at least one unit dose of medicaments, to a method for packaging at least one unit dose of medicaments, in which a packaging device according to the invention is selected, to a device for storing and dispensing at least one unit dose of medicaments and to a method for dispensing at least one unit dose of medicaments to a patient, which are characterised in combination by all or part of the features mentioned above or hereafter.

BRIEF DESCRIPTION OF THE DRAWINGS

Further aims, features and advantages of the invention will become apparent upon reading the following description, which is provided by way of a non-limiting example, and with reference to the accompanying figures, in which.

Figure 1:
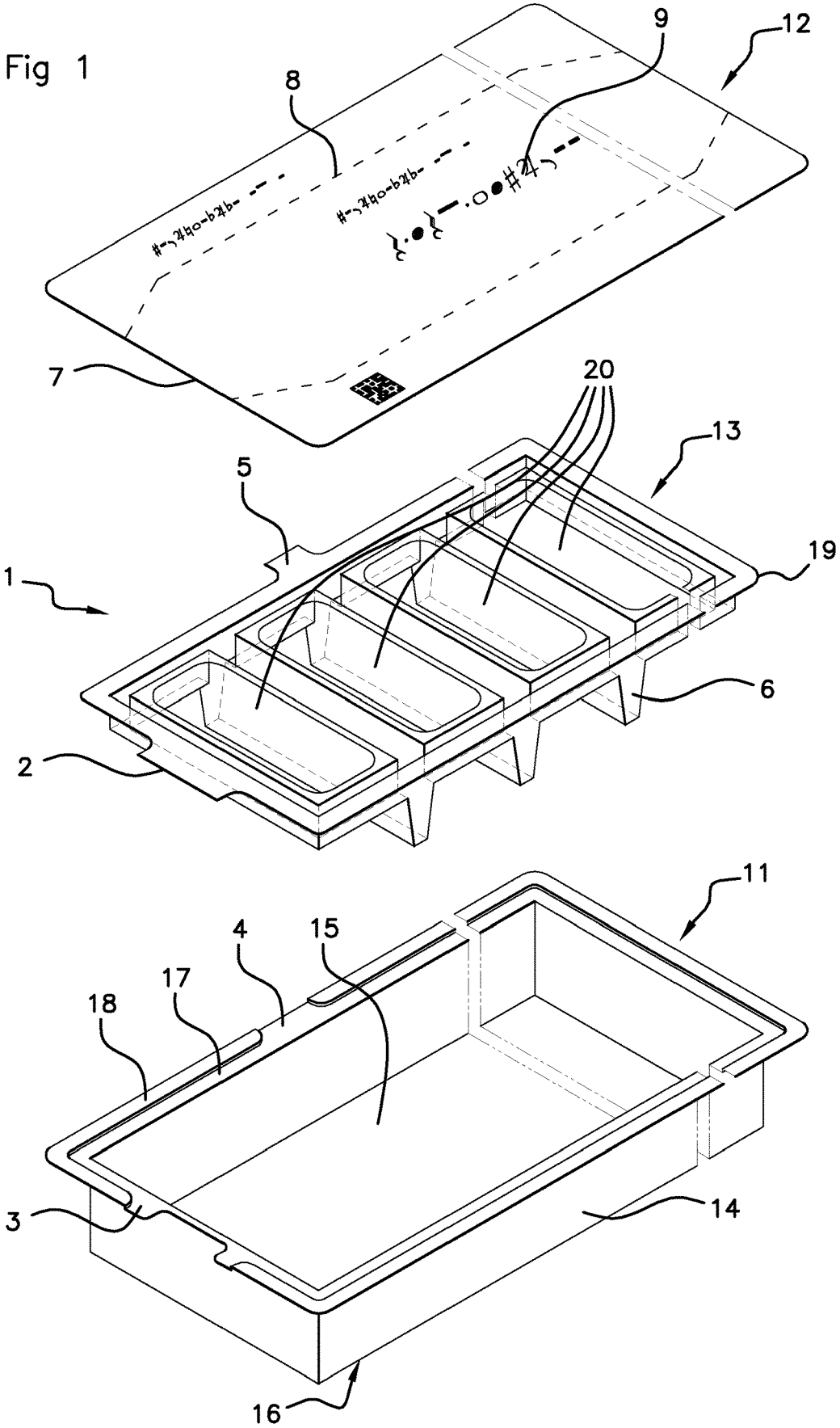
FIG. 1 is a perspective view of a packaging device according to a first variant of the invention adapted to form a single cell and shown in the disconnected state before packaging a unit dose of medicaments.

A packaging device 1 according to the invention, shown in FIG. 1, comprises a dish 11 for storing a unit dose of medicaments. The dish 11 shown in FIG. 1 is devoid of medicaments. The dish 11 is formed by a material that is compatible with being able to be placed in contact with the medicaments of the unit dose. The dish 11 preferably is formed as a single piece from a thermoplastic material, for example, polyvinyl chloride (PVC), or from a thermosetting material. The dish 11 can be obtained, for example, by thermoforming the thermoplastic material. The thermoplastic material preferably is transparent and allows the unit dose of medicaments packed in the device 1 to be viewed, in the assembled state, provided with medicaments and ready to be used by a patient.

The dish 11 has a volume 15 for storing a unit dose of medicaments that is limited by substantially flat lateral walls 14 and by a bottom 16, which is also substantially flat. The lateral walls 14 and the bottom 16 provide an opening emerging from the dish 11 and the storage volume 15. With the dish 11 shown in FIG. 1 being of substantially rectangular parallelepiped shape, the opening of the dish 11 is of rectangular shape and has an internal edge 17 for receiving and centring the removable partition 13 and a peripheral shoulder 18 for adhering the cover 12 to the substantially flat upper face of the peripheral shoulder 18. The internal edge 17 has a substantially flat upper face capable of cooperating with a matching lower face of a peripheral edge 19 of the removable partition 13. The peripheral shoulder 18 can have a discontinuity 3 that is adapted and sized to be able to receive a tab 2 for gripping the removable partition 13. With the peripheral shoulder 18 of the opening of the dish 11 being of rectangular shape, the discontinuity 3 preferably extends to one of the longitudinal ends of the dish 11. It is possible that the peripheral shoulder 18 has at least one other lateral discontinuity 4 extending over the length of the dish and being adapted to receive a breakable link tab 5 extending between two adjacent removable partitions 13.

The device shown in FIG. 1 has a removable partition 13 that is adapted and sized to be able to be positioned in the storage volume 15 of the dish 11. The removable partition 13 has a plurality of transverse partitions 6 adapted to provide, with the dish 11 and the cover 12, a plurality of compartments 20 for storing medicaments of a unit dose of medicaments. The medicaments of the unit dose of medicaments are then separated from one another by the transverse partitions 6 when they are stored. Each transverse partition 6 shown in FIG. 1 has two main faces that are not parallel and form, in the dish 11, compartments 20 that are flared towards the bottom 16 of the dish, increasing the surface of the bottom of the dish that is accessible to the medicaments of the unit dose and improving the distribution of these medicaments on the bottom of the dish. However, it is possible that, with each transverse partition having two main faces that are not parallel, they form upwardly flared compartments in the dish, i.e. compartments in which the opening has a surface area that is greater than the surface area of the bottom. Such upwardly flared compartments grant easier access to the compartments when they are filled. By combining these two advantages, there is nothing preventing each transverse partition from having two parallel main faces.

The removable partition 13 has an edge 19 on the periphery of the removable partition that is adapted to cooperate with the internal edge 17 of the dish 11 and in such a way that the substantially flat upper face of the peripheral shoulder 18 and the upper face of the peripheral edge 19 of the removable partition are coplanar and can, where necessary, together form the adhesion surface of the cover 12.

The device shown in FIG. 1 has a cover 12 that is sized to close the storage volume 15. This cover 12 can be formed by an adhesive material on only one of its main faces, named adhesive face. It can involve an adhesive cellulose material, in particular adhesive paper. One of the main faces of the cover 12 is adapted to be placed facing the storage volume 15 and is provided with a layer of adhesive material protected by a protective film over the entire surface of the cover 12 when the device 1 according to the invention is in the disconnected state (in "kit" form), with the dish 11, the cover 12 and the removable partition 13 being adapted to be able to form a closed storage cell of a unit dose of medicaments containing the unit dose of medicaments, or when the device 1 according to the invention is in the partially assembled state, i.e. in which the removable partition 13 is disposed in the storage volume 15 by forming, together with the dish 11, compartments 20 for storing medicaments, with the cover 12 not sealing the opening of the dish 11.

A peripheral part of the protective film of the cover 12 is able to be removed so that the corresponding peripheral part of the cover 12 can be adhered to the peripheral shoulder 18 of the opening of the dish 11, with the unit dose of medicaments being distributed in the compartments 20 for storing medicaments. After the cover 12 is adhered to the dish 11 containing the removable partition 13 and the unit dose of medicaments, the device 1 is a device for storing a unit dose of medicaments, provided with medicaments and ready to be used by a patient.

A peripheral part of the protective film of the cover 12 is able to be removed so that the corresponding peripheral part of the cover 12 can be adhered to the peripheral shoulder 18 of the opening of the dish 11, with the unit dose of medicaments being distributed in the compartments 20 for storing medicaments.

The cover also has a main face opposite the adhesive face having inscriptions 9 able to be read by the patient, by medical staff or by a barcode or QR code reader. The inscriptions 9 can relate to the identity of the patient and/or to the date and to the time for taking the unit dose of medicaments and/or to the medical prescription, in particular the type, the dose and the dosing schedule of the medicament(s).

The cover 12 has a perforation 8 adapted to allow the cell 10 for storing the unit dose of medicaments to be opened. The cover 12 also has a tab 7 for opening the cell 10 that is adapted to allow the patient to grip the end of the cover 12, tear the cover 12 along the perforation 8, remove the removable partition 13 from the dish 11, and form the unit dose of medicaments.

In a first particular embodiment of the invention, the cover 12 is only adhered to the peripheral shoulder 18 of the dish 11 and, where necessary, to the end of the tab 2 for gripping the removable partition 13. In this embodiment, opening the cell 10 by tearing the cover 12 along the perforation 8 is not accompanied by the simultaneous extraction of the removable partition 13. In this embodiment, a subsequent step of extracting the removable partition 13 is required to form the unit dose of medicaments in the dish 11. Of course, the perforation 8 is selected and sized to allow the subsequent step of extracting the removable partition 13 without requiring additional tearing of the cover 12.

In a second particular embodiment of the invention, the cover 12 is adhered to the peripheral shoulder 18 of the dish 11 and to the peripheral edge 19 of the removable partition 13. In this second embodiment, tearing the cover 12 along the perforation 8 located between the zone for adhering the peripheral shoulder 18 of the dish 11 and the zone for adhering the peripheral edge 19 of the removable partition 13 is accompanied by the opening of the storage cell 10, but also, and simultaneously, by the extraction of the removable partition 13.

Figure 2:
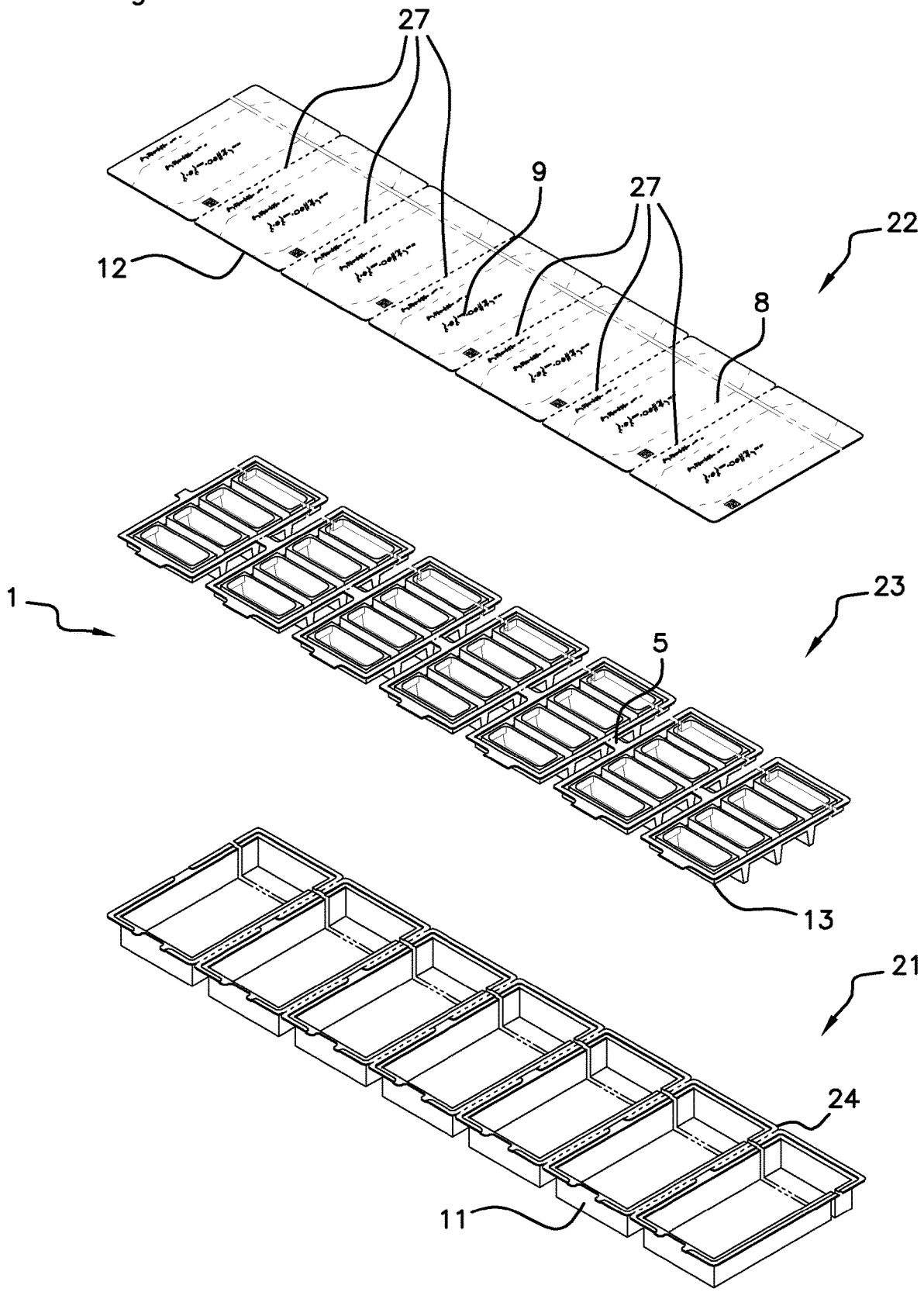
FIG. 2 is a perspective view of a packaging device according to a second variant of the invention adapted to form a plurality of cells and shown in the disconnected state before packaging a plurality of unit doses of medicaments.

A second variant of a device 1 according to the invention, shown in FIG. 2, comprises a plurality of storage dishes 21 connected to one another. In this second shown variant, the storage dishes 21 are devoid of medicaments. The plurality of storage dishes 21 is organised in the form of a column of 7 dishes 11, with each dish 11 corresponding to a daily dose of medicaments. The device 1 according to the invention shown in FIG. 2 therefore allows a unit and daily dose of medicaments to be provided, once-a-day, for 7 days. Of course, there is nothing preventing the device 1 according to the invention from having 4 columns of 7 dishes 11, with each column of 7 dishes 11 corresponding to one of the 4 daily doses (breakfast, lunch, dinner and bedtime) of medicaments. The device 1 according to the invention therefore can be a weekly pill container.

Each dish 11 of the plurality of dishes 21 for storing medicaments is separated from the adjacent dishes 11 by a link provided with a perforation 24 for separating the dishes 11. Each removable partition 13 of the plurality of removable partitions 23 is separated from the adjacent removable partitions 13 by a tab 5 with a breakable link and for separating the removable partitions 13. Each cover 12 of the plurality of covers 22 is separated from the adjacent covers 12 by a perforation 27 for separating the covers 12. Thus, each cell formed by a dish 11, a removable partition 13, a cover 12 and comprising a unit dose of medicaments can be separated from the other cells of the plurality of cells simply by cutting, by benefiting from the combined effect of the perforation 24 for separating the dishes 11, the breakable link tab 5 and the perforation 27 of the cover 12.

Figure 3:
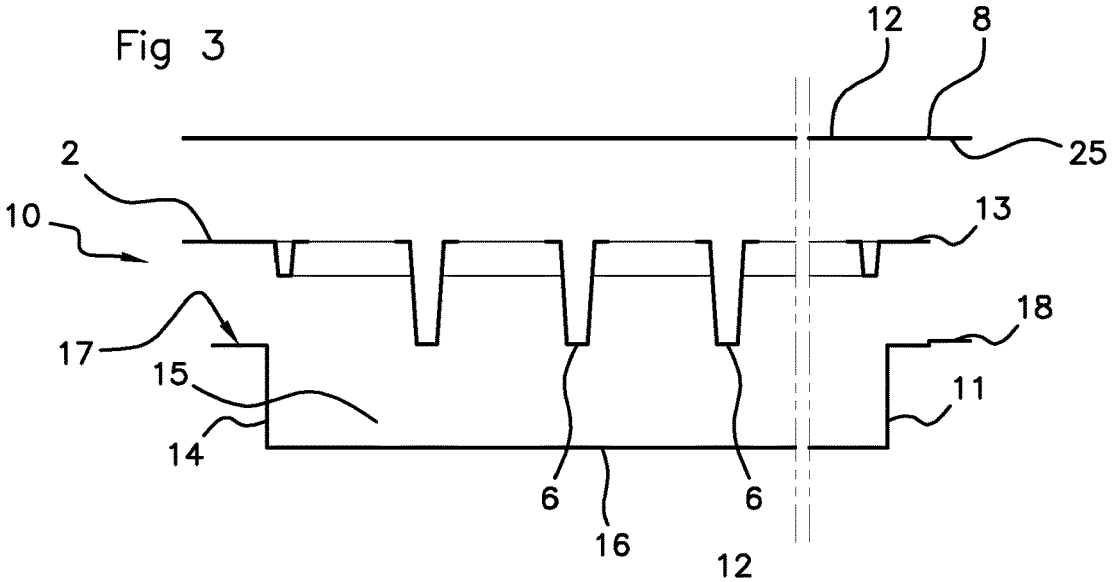
FIG. 3 is a longitudinal section view perpendicular to the median plane of the dish of a first variant of a packaging device according to the invention, as shown in FIG. 1.

An exploded longitudinal section view in the median plane of a storage cell 10 devoid of medicaments is shown in FIG. 3. The storage cell 10 comprises a dish 11 determining a dedicated volume 15 for storing medicaments, which is limited by flat lateral walls 14 and by a bottom 16, which is also flat. The dish 11 has an internal edge 17 that is shaped to be able to support and centre, in combination with a shoulder 18, the removable partition 13 in the dish 11. The dish 11 also has a peripheral shoulder 18 for adhering the cover 12 to the flat upper face of the peripheral shoulder 18. The removable partition 13 has a plurality of transverse partitions 6 adapted to be able to, together with the dish 11 when the peripheral edge 19 of the removable partition 13 rests on the internal edge 17 of the dish 11, form a plurality of compartments 20 for storing medicaments of a unit dose of medicaments, the medicaments being separated from one another.

A peripheral part of the protective film of the cover 12 is able to be removed so that the corresponding peripheral part of the cover 12 forms an adhesion edge 25 and can be adhered to the peripheral shoulder 18 of the opening of the dish 11, with the unit dose of medicaments being distributed in the compartments 20 for storing medicaments. In this embodiment, the removable partition 13 does not adhere to the cover 12, so that it is not extracted from the dish upon opening the cell 10.

Figure 4:
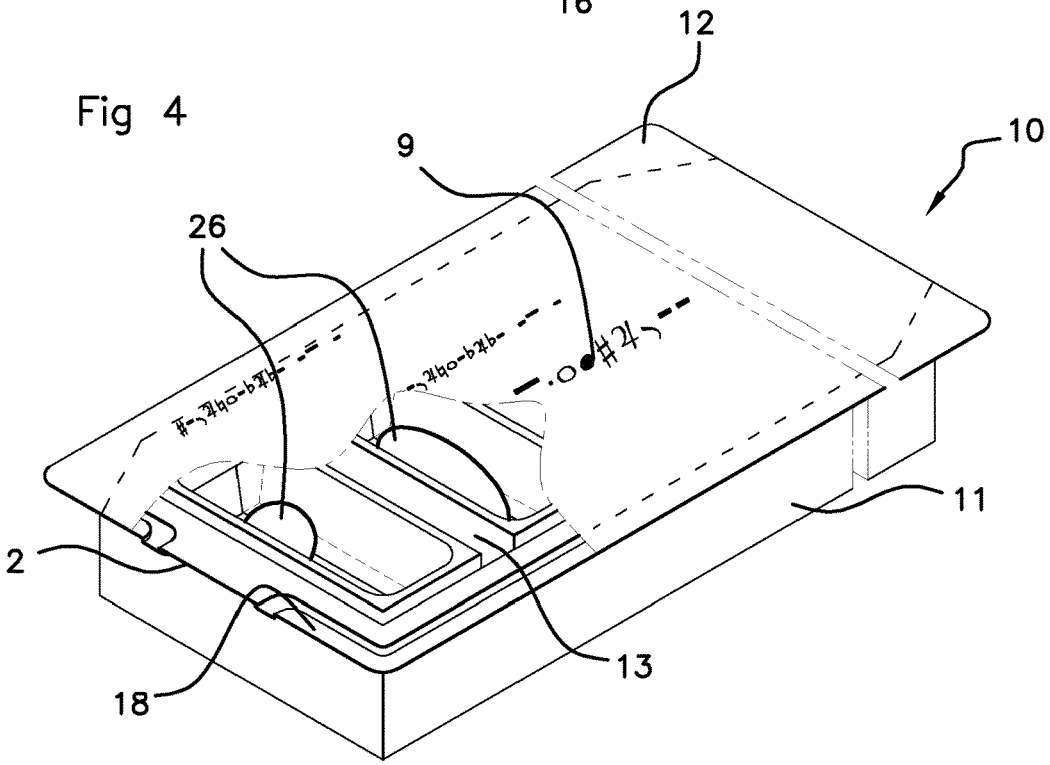
FIG. 4 is a perspective view with a cut-out of a storage and dispensing device according to the invention obtained by assembling a packaging device, as shown in FIG. 1, and a unit dose of medicaments.

FIG. 4 shows a device according to a first variant of the invention formed by a single cell 10 in the state in which it is provided with a unit dose of medicaments. The cell 10 comprises a storage dish 11, a removable partition 13 disposed in the volume formed by the dish 11 and a cover 12 adhered to the peripheral shoulder 18 of the dish 11. Medicaments 26 in a divided solid pharmaceutical dosage form, in particular not entirely in powdered form, preferably not in powdered form, are disposed in at least two storage compartments 20. The medicaments 26 are able to be in contact with the protective film of the adhesive layer over the entire surface of the cover 12 without adhering to the cover and without altering the properties of the medicaments 26. The medicaments 26 are not able to be in contact with the adhesive layer part of the cover 12 devoid of a protective film and adhered to the peripheral shoulder 18 of the dish 11.

Figure 5:
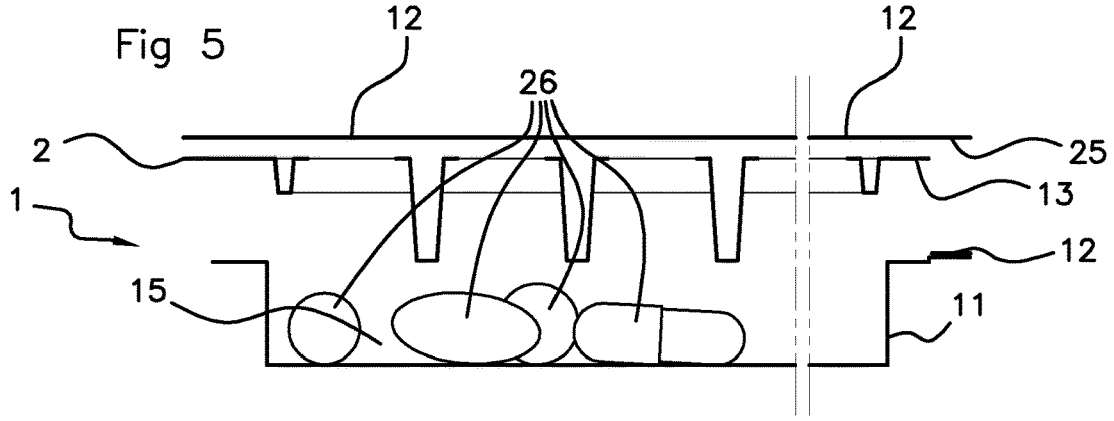
FIG. 5 is a longitudinal section view perpendicular to the median plane of the dish of a cell of a device for storing and dispensing a unit dose of medicaments according to the invention in a state of dispensing a unit dose of medicaments.

A device 1 according to the invention in a state of providing a patient with a unit dose of medicaments is shown as a longitudinal section view in the median plane in FIG. 5. This device 1 is formed from a cell 10, as shown in FIG. 4 comprising a unit dose of medicaments. In this dispensing state, the cover 12 is associated with the removable partition 13 by peripheral adhesion, so that opening the cell by tearing the cover 12 along the perforations for opening the cover 12 is accompanied by the extraction of the removable partition 13 from the dish 11 and the release of the medicaments of the unit dose of medicaments in the dish 11.

Figure 6:
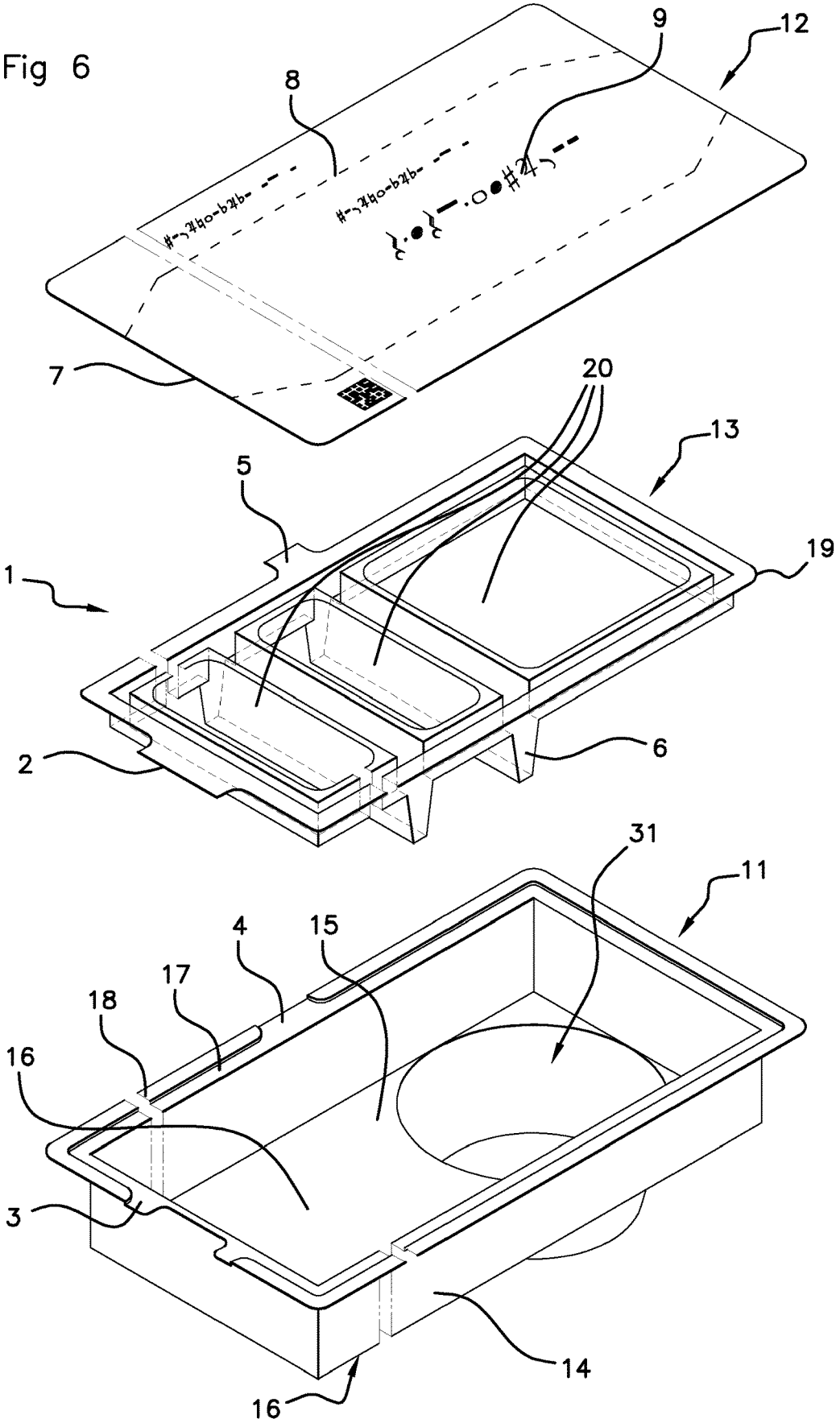
FIG. 6 is a perspective view of a packaging device according to a particular aspect of the invention adapted to form a single cell and shown in the disconnected state before packaging a unit dose of medicaments.

A particular aspect of a packaging device 1 according to the invention is shown in FIG. 6. In such a packaging device 1, the cover 12 and the removable partition 13 are as described in FIG. 1. The packaging device 1 shown in FIG. 6 has a dish 11 that is devoid of medicaments. The dish 11 is formed as a single part from a thermoplastic material, for example, polyvinyl chloride (PVC). The dish 11 can be obtained by thermoforming the thermoplastic material, for example.

The dish 11 delimits a volume 15 for storing the unit dose of medicaments that is limited by substantially flat lateral walls 14 and by a bottom 16, which is also substantially flat. The dish 11 shown in FIG. 6 has a bottom 16 comprising a bottom 30 for storing medicaments. The bottom 30 for storing medicaments is substantially flat and extends, when the removable partition 13 is placed in the storage volume of the dish 11, facing the transverse partitions 6 of the partition and forms, with these transverse partitions 6, compartments 20 for keeping the medicaments of the unit dose separate from one another.

The bottom 16 of the dish 11 shown in FIG. 6 has an indentation 31 forming a receptacle for the medicaments of a unit dose of medicaments. The indentation 31 can assume any form. Preferably, the indentation 31 is of rotationally symmetrical shape. The indentation 31 exhibits mechanical resistance that is selected to allow crushing and/or grinding of the medicaments contained in the indentation. The indentation 31 is formed by a material, for which the mechanical resistance, in particular the mechanical abrasion resistance, and the thickness are selected to allow crushing and/or grinding. The material forming the indentation 31 is selected to be able to be in contact with a food product and to allow crushed/ground medicaments to be mixed with a soft consistency food product and the resulting mixture to be taken by the patient. The indentation 31 forms a crushing and/or grinding mortar for the medicaments of the unit dose of medicaments. The type and the thickness of the material forming the indentation is adapted to allow the medicaments to be crushed. The type and the thickness of this material is adapted according to the procedure for crushing the medicaments using either a pestle or an external electrical crushing device. The indentation can have a substantially smooth internal surface. However, there is nothing preventing at least one part of the internal surface of the indentation from having asperities (or "teeth") cooperating with the pestle in order to crush the medicaments.

The bottom 16 of the dish 11 is flat, smooth and allows the medicaments of the unit dose of medicaments to slide from the bottom 30 for storing medicaments towards the indentation 31 simply by inclining the dish.

Figure 7:
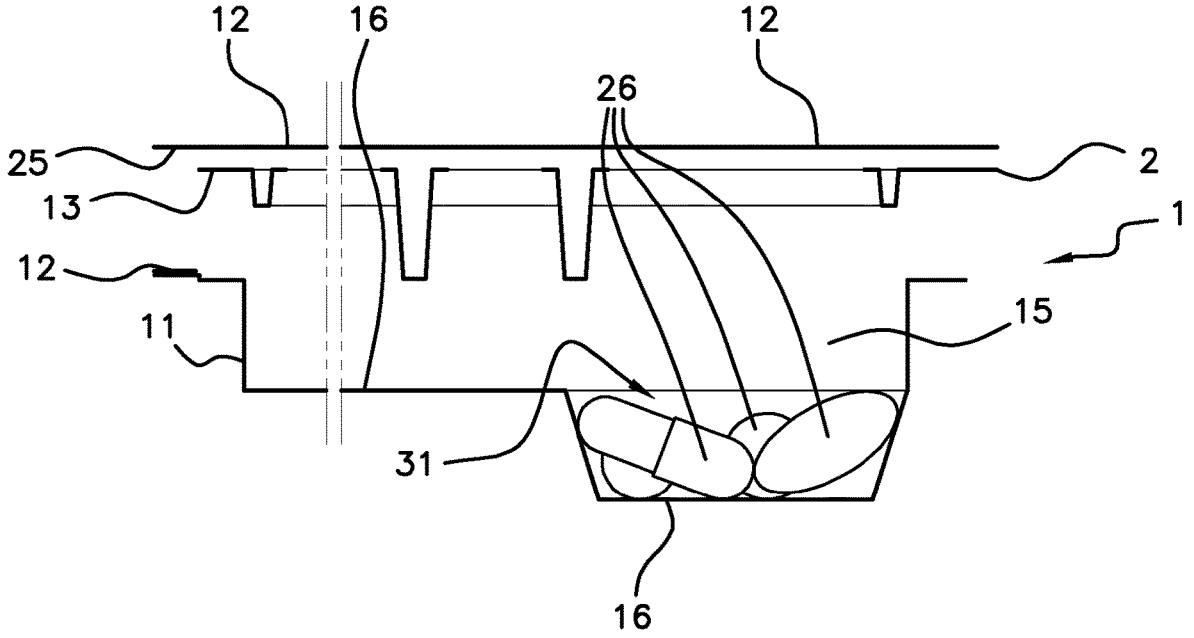
FIG. 7 is a longitudinal section view perpendicular to the median plane of the dish of a cell of a particular aspect of a device for storing and dispensing a unit dose of medicaments according to the invention.

A device 1 according to a particular aspect of the invention in a state of providing a patient with a unit dose of medicaments is shown as a longitudinal section view in the median plane in FIG. 7. This device 1 is formed from a cell 10, as shown in FIG. 5. In this dispensing state, the cover 12 is associated by peripheral adhesion to the removable partition 13, so that opening the cell by tearing the cover 12 along the perforations for opening the cover 12 is accompanied by the extraction of the removable partition 13 from the dish 11, the release of the medicaments of the unit dose of medicaments into the dish 11 and the sliding of the medicaments of the unit dose of medicaments from the bottom 30 for storing medicaments towards the indentation 31 simply by inclining the dish 11. The medicaments of the unit dose of medicaments contained in the indentation 31 are able to be crushed in the indentation 31 so as to form a powder, with the powder being subsequently mixed with a soft consistency food product, such as a jam or a compote, in order to be more easily consumed by the patient.

Figure 8:
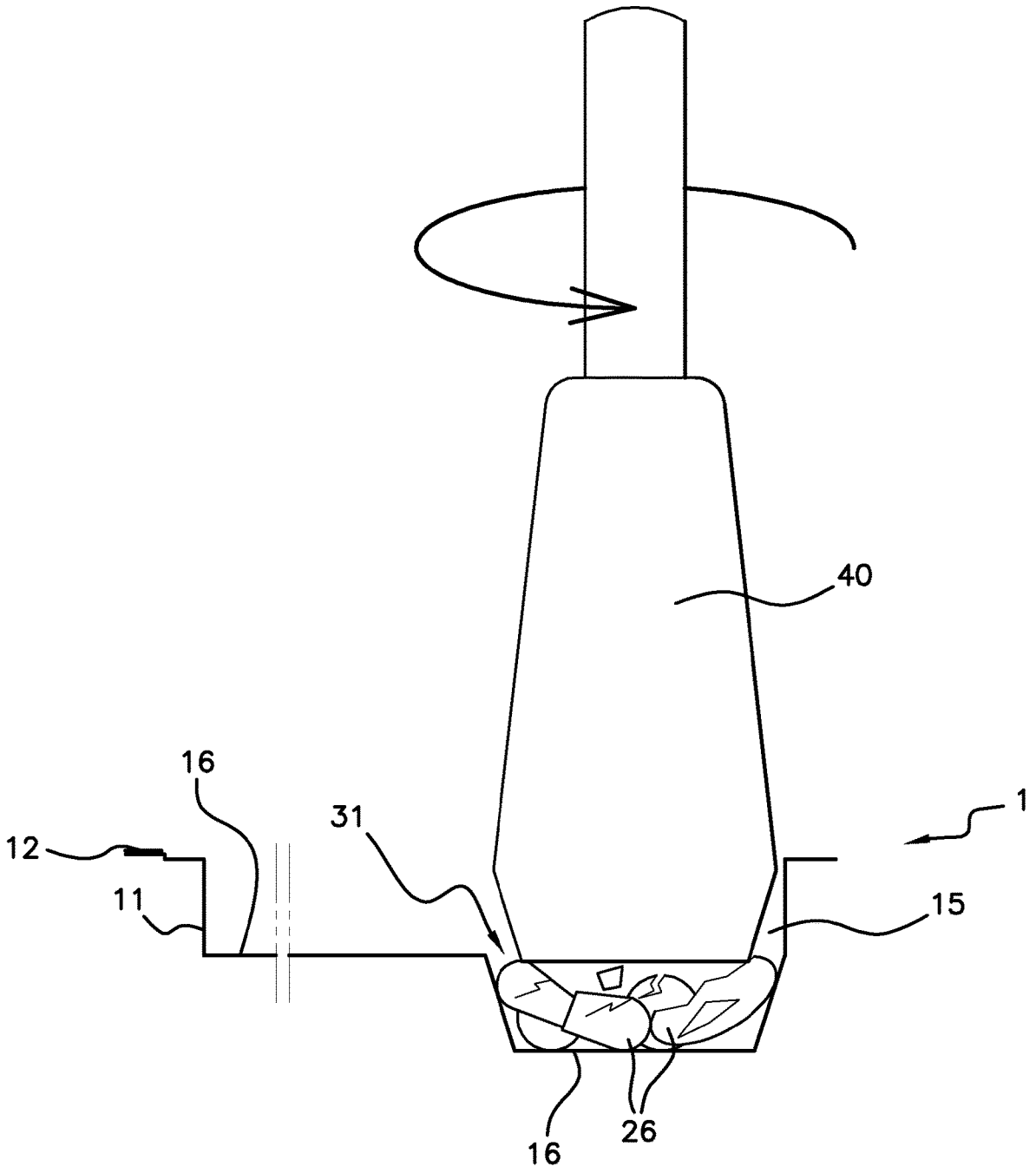
FIG. 8 is an illustration of a particular aspect of a method for dispensing a unit dose of medicaments according to the invention. The packaging devices and the devices for storing and dispensing at least one unit dose of medicaments according to the invention shown in FIGS. 1 to 8 are provided solely by way of non-limiting examples. Throughout these figures, the relative scales and dimensions are not necessarily followed.

The medicaments of the plurality of medicaments are crushed and/or ground by any suitable means, for example by means of a pestle 40, as shown in FIG. 8, with the indentation 31 acting as a crushing mortar. The pestle 40 is used normally, by using the pestle 40 to exert a pressure on the medicaments kept between the indentation 31 and the pestle 40 and by imposing a rotary movement on the pestle 40, causing the crushing/grinding of the medicaments. The crushing/grinding duration is adapted according to the particle size desired for the unit dose of crushed medicaments.

In one variant, not shown, of a device according to the invention, in which the cover is not associated with the removable partition by peripheral adhesion, opening the cell by tearing the cover along the perforations for opening the cover is not accompanied by simultaneous extraction of the removable partition from the dish. In this variant, the removable partition needs to be extracted by means of the tab for gripping the removable partition in order to release the medicaments of the unit dose of medicaments into the dish.

The invention also relates to a method for packaging at least one unit dose of medicaments in a divided solid pharmaceutical dosage form with a view to it being stored and dispensed. In such a method, a device according to the invention is selected comprising at least one dish for storing a unit dose of medicaments, at least one removable partition and at least one cover. Each removable partition is placed in a dish so as to provide, in each dish, a plurality of compartments adapted to be able to keep the medicaments of the unit dose separate from one another. The medicaments corresponding to a medical prescription are then disposed in each compartment of each cell, then the cell(s) is/are closed by applying a cover onto the opening of each cell. The unit dose of medicaments and the device according to the invention provided with the unit dose of medicaments are then ready to be dispensed to a patient.

In particular, such packaging of a unit dose of medicaments can be carried out in a device according to the invention using a method adapted from the method disclosed in prior document FR 2942132. A tray, named weekly tray, of dishes is selected, with the dishes being associated with one another by detachable links and being distributed in 4 columns and 7 rows corresponding to four daily doses (breakfast, lunch, dinner, bedtime) for 7 days. A removable partition is disposed in each dish. This can involve a plurality of removable partitions associated with one another by breakable links in a configuration that is selected so that each removable partition of the plurality of removable partitions is disposed in the volume of a dish. The tray of dishes equipped with removable partitions is surface mounted on a monitor of a computer system equipped with software for analysing a medical prescription, for two-dimensionally representing the dispensing of the medicaments of this medical prescription in each compartment of each dish of the tray of dishes and for assisting the dispensing of the medicaments according to the medical prescription. In this way, the compartments in which the medicaments of the unit dose of medicaments must be placed can be clearly seen through the dish(es).

Of course, this description is provided solely by way of an illustrative example and a person skilled in the art could apply various amendments thereto. Clearly, the invention can be the subject of various variants and applications. In particular, the sizing, the number and the shape of the dishes, the covers and the cells, the type of materials for the constituent elements of the packaging device and of the storage and dispensing device can vary without departing from the scope of protection of the invention.

The invention claimed is:

1. Device for packaging at least one unit dose of medicaments in a divided solid pharmaceutical dosage form forming at least one cell for storing and dispensing such a unit dose, each cell comprising:

a dish delimiting a volume for storing such a unit dose;

a cover adapted to close the storage volume;

a removable partition adapted to be able to extend into the storage volume of the dish and to delimit a plurality of compartments therein for keeping the medicaments of the unit dose separate from one another, the partition extending into the dish being able to be removed from the dish;

wherein the removable partition is a bottomless partition, and wherein said removable partition is removed from said dish, said medicaments of the unit dose are not separate from one another upon removal of the removable partition.

2. Device according to claim 1, wherein the dish has a peripheral shoulder delimiting an opening of the dish, the cover being formed by a sealing film adapted to be able to adhere to the peripheral shoulder of the dish.

3. Device according to claim 2, wherein the sealing film has a main face, named adhesive face, having at least one adhesive zone disposed in order to be able to adhere to the peripheral shoulder of the dish.

4. Device according to claim 3, wherein the sealing film has a second main face, named printed face, opposite said adhesive face and having at least one inscription.

5. Device according to claim 1, wherein the dish is of elongated shape in a main elongation direction and has:

a larger dimension parallel to the main elongation direction of the dish with a value between 60 mm and 150 mm; and a width in a direction perpendicular to the main elongation direction with a value between 20 mm and 50 mm.

6. Device according to claim 5, wherein the dish has a depth extending perpendicular to the main elongation direction, perpendicular to the width and with a value that is lower than the width, in particular between 10 mm and 20 mm.

7. Device according to claim 1, wherein the device is adapted to be able to form a plurality of cells for storing a plurality of unit doses of such medicaments, the cells of the plurality of storage cells being connected to one another in the form of a tray for storing and dispensing medicaments.

8. Device according to claim 1, wherein the device comprises:

a perforated tray for receiving medicaments, forming a plurality of juxtaposed dishes;

a perforated sheet of sealing films; and a perforated set of removable partitions.

9. Device according to claim 1, wherein a bottom part of the dish forms an indentation for collecting medicaments of the unit dose of medicaments that is adapted to be able to receive and contain the medicaments and to allow them to be crushed in the indentation.

10. Device according to claim 9, wherein the indentation is an indentation that can deform between a retracted form, in which the indentation does not allow the medicaments to be crushed, and a deployed form, in which the depth of the indentation is adapted to receive the medicaments and to allow them to be crushed.

11. Method for packaging at least one unit dose of medicaments in a divided solid pharmaceutical dosage form, wherein:

a packaging device according to claim 1 is selected;

a removable partition is placed in a dish of the packaging device;

medicaments in a divided solid pharmaceutical dosage form are divided into at least two storage compartments formed by the removable partition placed in the dish; and the dish of the device comprising the medicaments is closed by applying the cover.

12. Method according to claim 11, wherein:

a removable partition is placed in each dish of the packaging device;

medicaments in a divided solid pharmaceutical dosage form are divided into at least two storage compartments formed by the removable partition placed in each dish; and each dish of the device comprising the medicaments is closed by applying the cover.

13. Device for storing and dispensing at least one unit dose of medicaments in a divided solid pharmaceutical dosage form, each unit dose being intended to be administered to a patient at a predetermined time and being distributed in a cell for storing and dispensing such a unit dose, each cell comprising:

a dish delimiting a volume for storing such a unit dose and containing such a unit dose;

a cover adapted to close the storage volume;

a removable partition extending into the storage volume of the dish and delimiting a plurality of storage compartments therein for keeping the medicaments of the unit dose separate from one another, the partition extending into the dish;

the partition being able to be removed from the disk;

wherein the removable partition is a bottomless partition, and wherein when said removable partition is removed from said dish, said medicaments of the unit dose are not separate from one another upon removal of the removable partition.

14. Device according to claim 13, wherein the removable partition is secured to the cover so as to allow, during the opening of the storage cell, simultaneous extraction of the removable partition from the dish and random distribution of the medicaments in the dish, such random distribution being a distribution of the medicaments in the dish wherein the medicaments of the unit dose of medicaments are not separated from each other in the dish.

15. Device according to claim 13, wherein the removable partition is separated from the cover so that opening the storage cell necessitates delayed extraction of the removable partition from the dish, so as to form a random distribution of the medicaments in the dish, such random distribution being a distribution of the medicaments in the dish wherein the medicaments of the unit dose of medicaments are not separated from each other in the dish.

16. Device according to claim 13, wherein a bottom part of the dish forms an indentation for collecting medicaments of the unit dose of medicaments that is adapted to be able to receive and contain the medicaments and to allow them to be crushed in the indentation.

17. Method for dispensing at least one unit dose of medicaments in a divided solid pharmaceutical dosage form to a patient, wherein:

a device for storing and dispensing at least one unit dose of medicaments in a divided solid pharmaceutical dosage form according to claim 13 is selected;

a cell for storing and dispensing such a unit dose is separated from the storage device;

the cover of this cell of the storage and dispensing device corresponding to the unit dose of medicaments is removed; and the removable partition is extracted from this cell so that the medicaments are no longer separated from one another in the dish; and the unit dose of medicaments is dispensed to the patient.

18. Method according to claim 17, wherein the cover is removed and the removable partition is extracted simultaneously, with the removable partition being secured to the cover.

19. Method according to claim 17, wherein a bottom part of the dish forming an indentation for collecting and crushing medicaments of the unit dose of medicaments is sized to be able to receive and contain the medicaments, the medicaments are moved into the indentation following the extraction of the removable partition and the medicaments of the unit dose of medicaments are crushed in the indentation.

* * * * *